US005651038A

United States Patent [19]

Chechelnitsky et al.

[11] Patent Number: 5,651,038

[45] Date of Patent: Jul. 22, 1997

[54] SEALED BASKET FOR PRESSURIZED WATER REACTOR FUEL ASSEMBLIES

[75] Inventors: Boris A. Chechelnitsky, San Jose, Calif.; Thomas C. Thompson, Lawrenceville, Ga.; James E. Hopf, Santa Cruz, Calif.

[73] Assignee: Sierra Nuclear Corporation, Scotts Valley, Calif.

[21] Appl. No.: 597,130

[22] Filed: Feb. 6, 1996

[51] Int. Cl.[6] ..... G21F 5/012

[52] U.S. Cl. ..... 376/272

[58] Field of Search ..... 376/272; 250/506.1, 250/507.1

[56] References Cited

U.S. PATENT DOCUMENTS 3,845,315 10/1974 Blum ..... 376/272
4,781,883 11/1988 Daugherty et al. ..... 376/272
4,800,283 1/1989 Efferding ..... 376/272
4,827,139 5/1989 Wells et al. ..... 376/272
4,997,618 3/1991 Efferding ..... 376/272

*Primary Examiner*—Daniel D. Wasil

[57] ABSTRACT

A basket for a cask for transporting, storing, and containing pressurized water nuclear fuel assemblies, including an internal assembly of sleeves has a plurality of sleeves arranged in a uniform pattern and secured within a cylindrical shell. Each of the plurality of independent sleeves being sized to secure and contain a fuel assembly. The internal assembly of sleeves includes a set of single sleeves centrally positioned in the basket, a set of corner sleeves including a single sleeve in each corner of the basket, and a set of double sleeves. An internal support structure is positioned within the basket and includes a cross-shaped central support element and four angle shaped corner supports. Neutron poison material for absorbing neutrons is secured to an inner wall of each of the plurality of sleeves for maintaining fission reactions within the basket below a critical level necessary to sustain a fission reaction.

13 Claims, 3 Drawing Sheets

SEALED BASKET FOR PRESSURIZED WATER REACTOR FUEL ASSEMBLIES

BACKGROUND OF THE INVENTION

1. Field of Invention

This invention relates to shipping baskets and casks for storing and transporting spent nuclear waste materials, and particularly to multi-purpose baskets and casks for transporting, storing, and disposal of pressurized water reactor (PWR) plants waste spent fuel and other waste materials.

2. Description of the Related Art

Various baskets and casks have been proposed and implemented for transporting, storing, and disposal of nuclear waste material. However, previous baskets and casks have been limited by durability, cost, and failure to meet stringent regulatory criteria. The present invention overcomes all such limitations by providing a multi-purpose basket which is a separate component of and not integral with a cask which is typically used to encompasses a fuel basket.

A nuclear reactor operates by initiating, maintaining and controlling fission chain reactions. These reactions occur within fissionable material such as Uranium 235 placed within the core of the reactor. In commercial type reactors, nuclear fuel is most often configured in the form of fuel assemblies, which are approximately 12–15 feet long and have a square cross section. Nuclear fuel is both loaded into and removed from the nuclear reactor one assembly at a time.

Since the nuclear reactor operates generating fission chain reactions, the nuclear fuel within a fuel assembly gradually becomes depleted and fission product contaminants build up until it reaches the point that it is no longer capable of maintaining the chain reactions necessary for operation of the reactor. When this occurs, the fuel assembly is removed from the reactor and replaced by a new fuel assembly. The depleted or spent fuel assembly, although incapable of maintaining the fission chain reaction in the reactor, is still highly radioactive and generates a significant amount of heat. Typically, a spent fuel assembly is stored in a pool of water called a spent fuel pool for a period of time after it is removed from the reactor, until temperatures and radioactivity levels have decreased enough to make it safe to move to another form of storage, or transport to a facility for reprocessing or disposal of the spent material.

After a spent fuel assembly has cooled sufficiently to permit its transfer, one of several alternative events may occur. The fuel assembly may be packaged and moved to another location on the reactor site for interim storage, or it may be packaged and transported to a remote site, sometimes at a long distance from the reactor site, for reprocessing, storage, or disposal.

One type of nuclear power plant is a plant which uses two separate systems, completely isolated from one another, to produce power. The primary system circulates water through the reactor core and through a heat exchanger, which is used to transfer heat to the secondary system. Water in the primary system is kept at a high pressure which allows the water to achieve a high temperature without boiling. The heat transferred to the secondary system is used to produce steam which drives a turbine generator to produce electricity. This type of plant is referred to as a pressurized water reactor (PWR) plant. The fuel assemblies used within PWR reactors have characteristics such as size and composition that make them unique with respect to fuel assemblies from other types of nuclear reactors.

Although prior baskets and containers have been proposed and developed to store or transport nuclear fuels all suffer significant limitations and disadvantages. For example, U.S. Pat. No. 4,827,139 issued to Wells et al. discloses a cylindrical cask which contains a fuel basket composed of independent tubes. Such basket is integral with the cask, i.e. the basket is not a separate component, it is not separately sealed, and it cannot be removed from the cask after fuel has been loaded into it. The basket of Wells et al., for example, is capable of containing 31 fuel assembles of an unnamed type, while the basket of the present invention may hold 24 PWR reactor fuel assemblies. Moreover, the present invention comprises a multi-purpose basket which is a separate component not integral with a cask. After fuel assemblies have been loaded into the basket of the present invention, the basket is sealed and may be placed within and removed from various types of casks, such as storage casks, transportation casks, or transfer casks, thereby enabling the basket to be used for many different applications.

While other baskets have been proposed and configured to act as a separate and removable component of casks all differ significantly from the present invention by using a different basket structure than the sleeve and internal support structure disclosed herein and are restricted to accommodating fewer fuel assemblies.

The present invention encompasses a multi-purpose, sealed, fuel basket which secures and contains PWR water reactor type fuel assemblies. The basket of the present invention may be used for various applications including:

1. Storage of contained fuel assemblies inside of a storage cask for storage either at the reactor site of at a remote site.
2. Transporting of contained fuel assemblies from one location to another inside a transportation cask over public or private transportation routes.
3. Transfer means for transferring the contained fuel assemblies inside of a transfer cask between the spent fuel pool, a storage cask, and a transportation cask.
4. Disposal means for the disposal of spent nuclear fuel used in a facility or facilities constructed for the disposal of spent nuclear fuel.

The basket of the present invention provides a means to meet the very stringent set of criteria that has been established by regulatory authorities in order to ensure safety during the transportation and storage of nuclear fuel assemblies. The basket is specifically designed and constructed to ensure that the nuclear chain reaction is maintained below critical limits, and harmful radiation does not escape. The basket configuration assures that these conditions are maintained even under extreme circumstances such as accidents, geologic stress, pressure, and the like.

Accordingly, it is the primary object of this invention to provide a basket for the containment of nuclear waste from nuclear reactors which is extremely durable, resilient, easy to use, store, transport, and contain, and which is adaptable to a wide variety of storage casks, transportation casks, transfer casks, and contained fuel assemblies.

Additional objects and advantages of the invention will be set forth in the description which follows, and in part will be obvious from the description, or may be learned by practice of the invention. The objects and advantages of the invention may be realized and obtained by means of the instrumentality's and combinations particularly pointed out in the appended claims.

SUMMARY OF THE INVENTION

To achieve the foregoing objects, and in accordance with the purpose of the invention as embodied and broadly described herein, a basket for transporting, storing, and containing nuclear fuel assemblies is provided, comprising: an internal assembly of sleeves comprising a plurality of independent sleeves arranged in a uniform pattern and secured within a cylindrical shell. Each of the plurality of independent sleeves is sized to secure and contain a fuel assembly. The internal assembly of sleeves preferably comprises a set of single sleeves centrally positioned in the basket, a set of corner sleeves including a single sleeve in each corner of the basket, and a set of double sleeves. An internal support structure is provided including a cross-shaped central support element and four angle shaped corner supports. A sheet of neutron poison material is preferably positioned to an inner wall of each of the plurality of sleeves for maintaining fission reactions within the basket below a critical level necessary to sustain a fission reaction. A plurality of retaining clips are used for holding and securing the neutron poison material within the basket and a support element is used for positioning and securing the plurality of independent sleeves. A bottom plate is secured to the cylindrical shell providing vertical support means for the plurality of independent sleeves and a shield lid is secured to the cylindrical shell and includes access means for selective entry into the basket. A lid element is secured to the shield lid and to the cylindrical shell and includes access means for selective entry into the basket. A heat and radiation resistant coating is preferably applied to the cylindrical shell to protect the basket and facilitate decontamination of an exterior surface of the cylindrical shell.

There is also provided, in accordance with the invention a basket for a cask for transporting, storing, and containing pressurized water nuclear fuel assemblies, including an internal assembly of sleeves comprising a plurality of sleeves arranged in a uniform pattern and secured within a cylindrical shell. Each of the plurality of independent sleeves being sized to secure and contain a fuel assembly. The internal assembly of sleeves includes a set of single sleeves centrally positioned in the basket, a set of corner sleeves including a single sleeve in each corner of the basket, and a set of double sleeves. An internal support structure is positioned within the basket and includes a cross-shaped central support element and four angle shaped corner supports. Neutron poison material for absorbing neutrons is secured to an inner wall of each of the plurality of sleeves for maintaining fission reactions within the basket below a critical level necessary to sustain a fission reaction. A support element is secured within the basket for positioning and securing the plurality of independent sleeves. A bottom plate is secured to the cylindrical shell providing vertical support means for the plurality of independent sleeves and a shield for providing a shield element for the cylindrical shell is secured to the cylindrical shell including access means for selective entry into the basket. A lid for providing a lid element is secured to the shield means and to the cylindrical shell; the lid element including access means for selective entry into the basket. A heat and radiation resistant coating is preferably applied to the cylindrical exterior shell to protect the basket and facilitate decontamination of an exterior surface of the cylindrical shell.

BRIEF DESCRIPTION OF THE DRAWINGS

The accompanying drawings, which are incorporated in and constitute a part of the specification, illustrate a preferred embodiment of the invention and, together with a general description given above and the detailed description of the preferred embodiment given below, serve to explain the principles of the invention.

DESCRIPTION OF THE PREFERRED EMBODIMENTS

Figure 1:
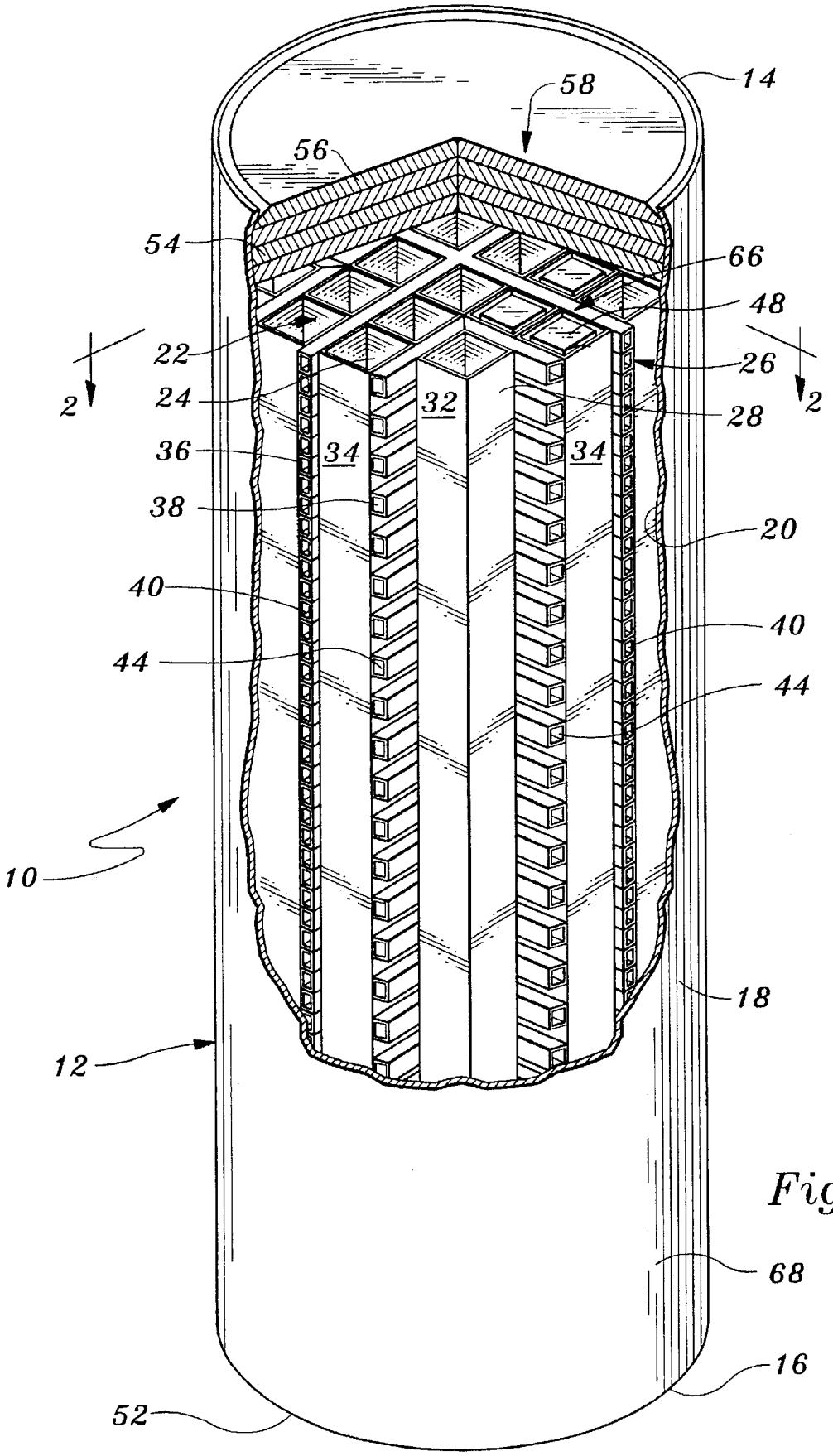
FIG. 1 is an isometric view of a sealed basket for pressurized water nuclear reactor fuel assemblies, according to the invention.

Reference will now be made in detail to the present preferred embodiments of the invention as illustrated in the accompanying drawings.

In accordance with the present invention, there is provided a basket for transporting, storing, and containing nuclear fuel assemblies, comprising: an internal assembly of sleeves comprising a plurality of independent sleeves arranged in a uniform pattern and secured within a cylindrical shell. Each of the plurality of independent sleeves is sized to secure and contain a fuel assembly. The internal assembly of sleeves preferably comprise a set of single sleeves centrally positioned in the basket, a set of corner sleeves including a single sleeve in each corner of the basket, and a set of double sleeves. An internal support structure is provided including a cross-shaped central support element and four angle shaped corner supports. A sheet of neutron poison material is preferably positioned to an inner wall of each of the plurality of sleeves for maintaining fission reactions within the basket below a critical level necessary to sustain a fission reaction. A plurality of retaining clips are used for holding and securing a neutron poison material within the basket and a support element is used for positioning and securing the plurality of independent sleeves. A bottom plate is secured to the cylindrical shell providing vertical support means for the plurality of independent sleeves and a shield lid is secured to the cylindrical shell and includes access means for selective entry into the basket. A lid element is secured to the shield lid and to the cylindrical shell and includes access means for selective entry into the basket. A heat and radiation resistant coating is preferably applied to the cylindrical shell to protect the basket and facilitate decontamination of an exterior surface of the cylindrical shell.

There is also provided, in accordance with the invention, a basket for a cask for transporting, storing, and containing pressurized water nuclear fuel assemblies, including an internal assembly of sleeves comprising a plurality of sleeves arranged in a uniform pattern and secured within a cylindrical shell. Each of the plurality of independent sleeves being sized to secure and contain a fuel assembly. The internal assembly of sleeves includes a set of single sleeves centrally positioned in the basket, a set of corner sleeves including a single sleeve in each corner of the basket, and a set of double sleeves. An internal support structure is positioned within the basket and includes a cross-shaped central support element and four angle shaped corner supports. Neutron poison material for absorbing neutrons is secured to an inner wall of each of the plurality of sleeves for maintaining fission reactions within the basket below a critical level necessary to sustain a fission reaction. A support element is secured within the basket for positioning and securing the plurality of independent sleeves. A bottom plate is secured to the cylindrical shell providing vertical support means for the plurality of independent sleeves and a shield for the cylindrical shell is secured to the cylindrical shell including access means for selective entry into the basket. A lid element is secured to the shield means and to the cylindrical shell. The lid element including access means for selective entry into the basket. A heat and radiation resistant coating is applied to the cylindrical exterior shell to protect the basket and facilitate decontamination of an exterior surface of the cylindrical shell.

In FIG. 1, the multi-purpose sealed pressurized water reactor (PWR) fuel basket 10 for holding and securing fuel assemblies 66 is shown with shell 12 having a top end 14, a bottom end 16, an outer wall 18 with heat and radiation resistant coating 68, well known in the art, such as siloxane polymer or other heat resistant paints and an inner wall 20, according to a preferred embodiment of the invention. Shell 12 is preferably cylindrically configured but may be provided in other geometric configurations if desired, such as circular, square, rectangular, or the like. Basket 10 is preferably composed of a durable, resilient, non-corrosive material such as steel or steel alloys, and is typically shipped or transported in a transportation, storage, or shipping cask commonly used in the art. As seen in FIG. 1, basket 10 includes an assembly of independent sleeves 22 with inner walls 25, comprising a plurality of independent sleeves 24, each being sized to secure and contain a fuel assembly. Sleeves 24 are preferably configured having a square cross section and positioned and secured in a uniform pattern inside shell 12.

Figure 3:
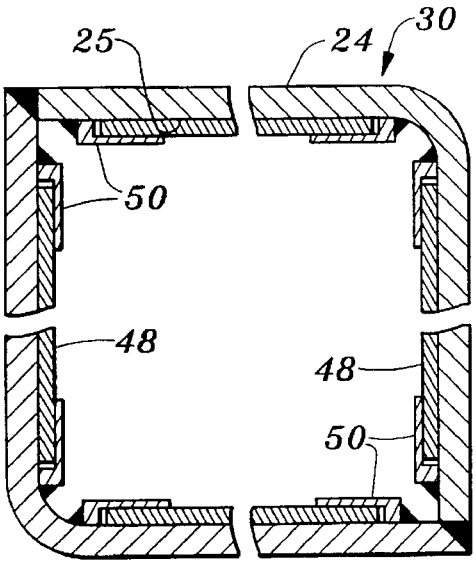
FIG. 3 is a sectional view of a center sleeve element, according to the invention.
Figure 4:
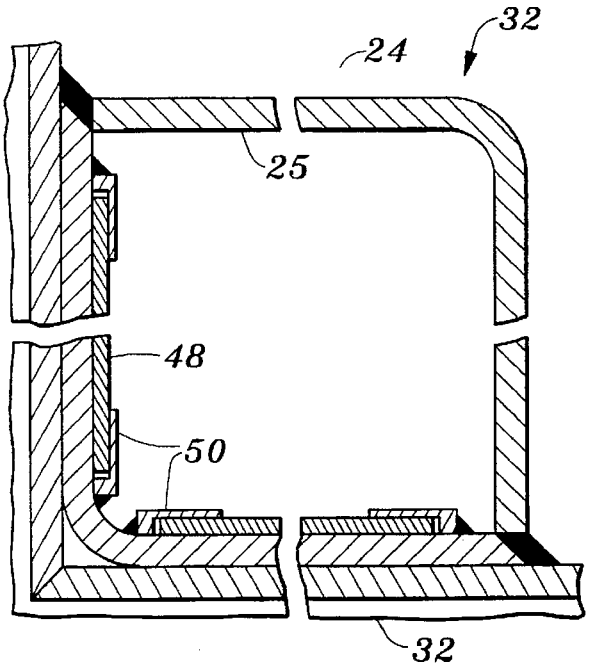
FIG. 4 is a sectional view of a corner sleeve, according to the invention.

The present invention provides a separate, multi-purpose fuel basket 10 preferably configured and sized to contain 24 pressurized water reactor fuel assemblies. Structural support for sleeves 22 is preferably provided by an internal support structure 26 configured to support and position sleeves 22 and composed of a durable resilient material such as steel or steel alloy. Preferably the sleeve assembly and support structure are configured to divide the inner basket into four quadrants 28 with each quadrant containing six sleeves. Each quadrant 28 preferably includes center sleeve 30, best seen in FIG. 3, and corner sleeve 32 best seen in FIG. 4. The center sleeve 30 and the corner sleeve 32 in each quadrant are preferably each single, independent sleeves, which bear against adjacent sleeves 24, support structure 26, and inner shell wall 20. Within each quadrant 28 are also positioned and secured two sets of double sleeves 34, best seen in FIG. 4, which also bear against adjacent sleeves 24, support structure 26, and inner shell wall 20, however, in the preferred embodiment are not directly attached to them. Corner sleeves 32 are positioned and secured, one in each of the quadrants 28 and are preferably of a larger size and having a greater cross sectional area than center sleeves 30 or double sleeves 34 so that they may be used to accommodate distorted, damaged or failed fuel assemblies.

Figure 2:
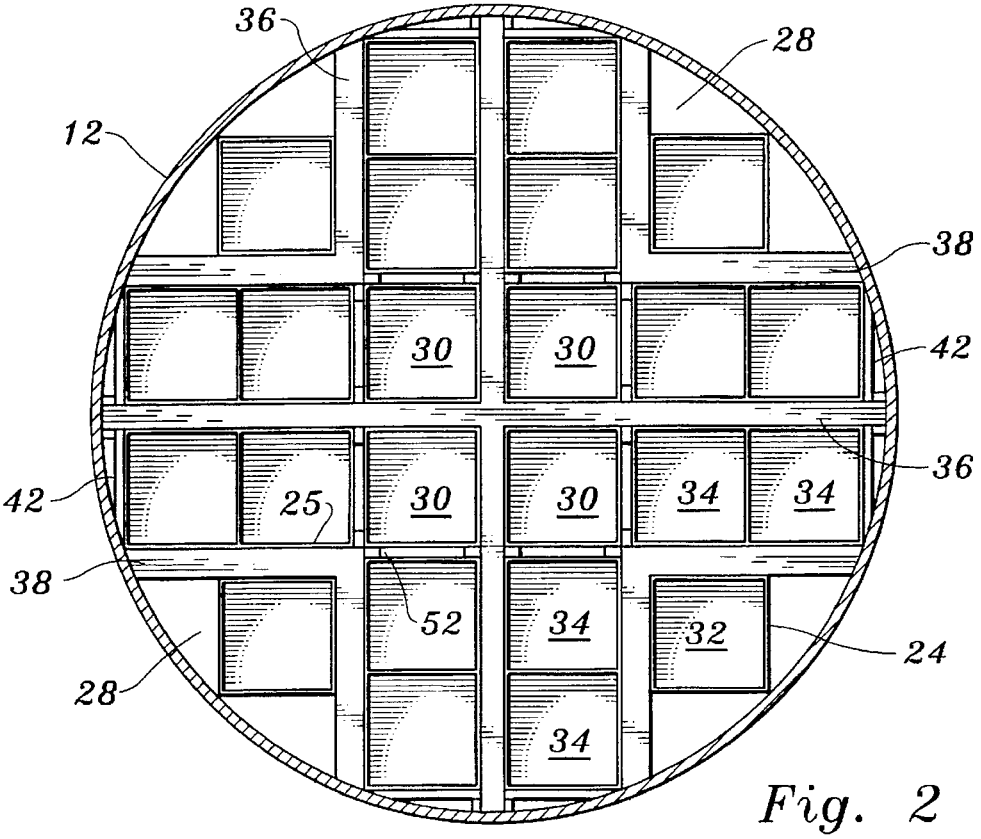
FIG. 2 is a sectional view of such sealed basket, according to the invention.

In reference to FIGS. 1 and 2, internal support structure 26 preferably includes a cross-shaped center support structure 36 and four angle-shaped corner supports 38, one located in each quadrant 28. Center support 36 is preferably composed of a plurality of rectangular-shaped tubes 40 welded together to form a cross. The center support crosses 36 are preferably stacked on top of one another along the length of the basket 10 to provide continuous support to the adjacent sleeves. Support crosses 36 are preferably held within basket 10 by angular shaped alignment plates 42 welded to the inner wall 20 of shell 12 near the ends of each support cross 36. Alignment plates 42 are preferably not attached to either the sleeves or support crosses 36, but are positioned so as to allow only limited movement of the adjacent sleeves and ends of the cross supports.

The angular shaped corner supports 38 are preferably made of a plurality of rectangular tubes 44 welded together to form a ninety degree angle. Each end of the corner supports 38 are preferably welded to inner wall 20 of cylindrical shell 12. Corner supports 38 are preferably uniformly spaced along the length of basket 10 and provide support to the adjacent sleeves.

Figure 5:
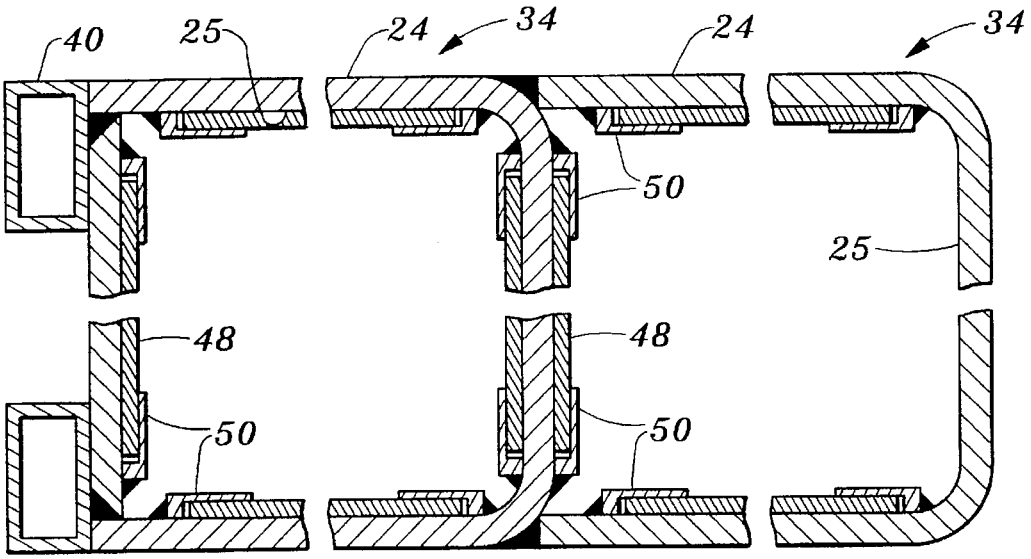
FIG. 5 is a sectional view of a double sleeve, according to the invention.

Referring now to FIG. 5, separation is provided between center sleeves 30 and adjacent double sleeves 34 by tubes 46 welded to the double sleeves 34 along the length of the sleeves, preferably near the corners thereof. Separation is also provided between other adjacent sleeves in basket 10 by tubes 40 forming center support cross 36. Spaces 52, provided between adjacent sleeves may be filled with water to form flux traps. Sheets of neutron poison material 48 are attached to the inside walls 25 of sleeves, 22, 24, 30, 32, and 34 throughout the basket. The neutron poison material preferably comprises a boron-carbide and alumium matrix, however other compounds may also for this purpose and are well known in the art. The sheets of neutron poison material 48 are preferably secured within basket 10 by retaining clips 50 preferably welded to the sleeve walls. Both the flux traps and neutron poison sheets 48 serve to maintain fission reactions within the basket below the critical level necessary to sustain a fission chain reaction.

In FIG. 1 a bottom plate 52 is shown and is preferably welded to cylindrical shell 12 providing vertical support means for sleeves 24. Bottom plate 52 is preferably composed of a durable, resilient, non-corrosive material such as steel, steel alloy, or the like, and may be secured to cylindrical shell 12 by welds or other mechanical fastening means.

Figure 6:
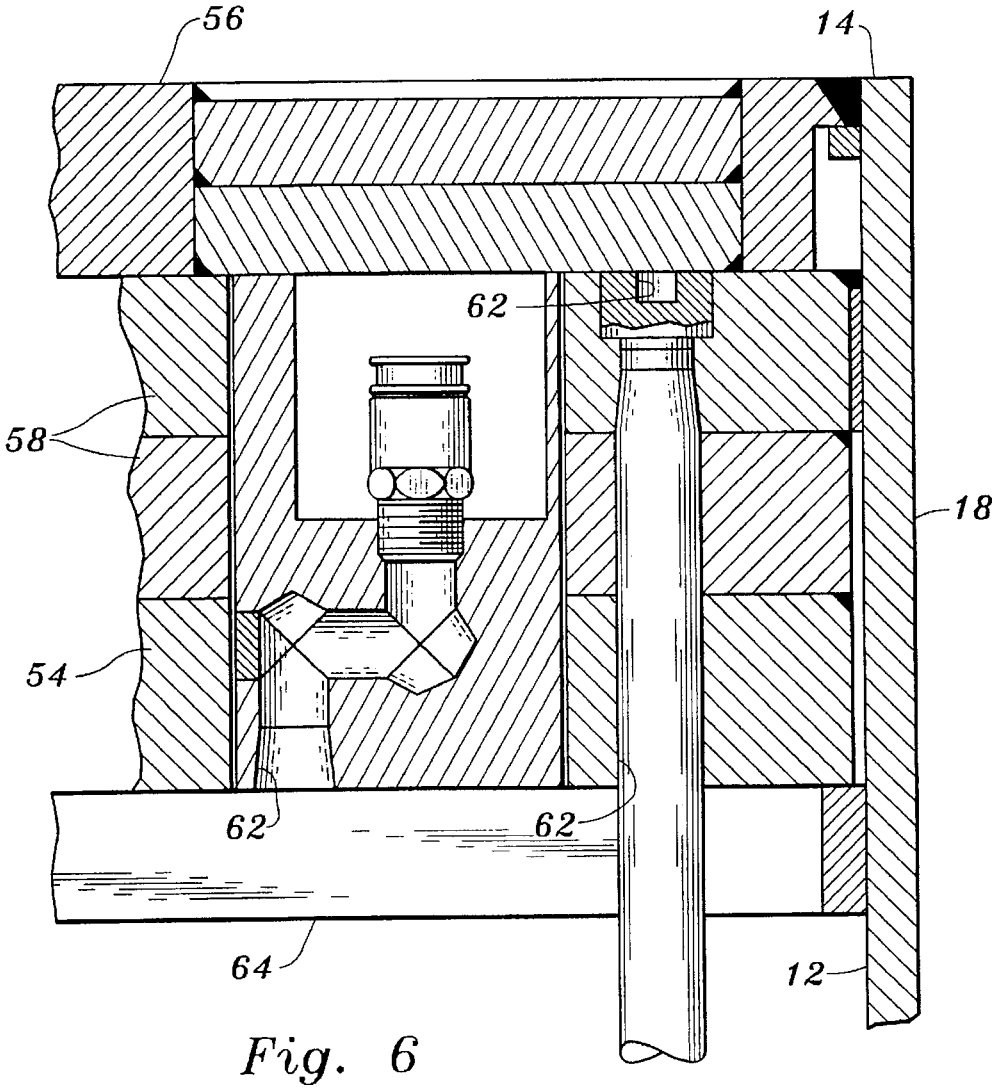
FIG. 6 is a sectional view of the shield lid and structural lid intersection with the cylindrical shell, according to the invention.

Referring now to FIGS. 1 and 6, a shield lid 54 and structural lid 56 are shown installed on basket 10. Shield lid 54 provides shielding from radiation emanating from fuel assemblies contained in sleeves 24. Shield lid 54 is preferably composed of a plurality of steel disks 58 welded together and which preferably sandwich a section of the sheet of neutron poison material. Structural lid 56 is preferably a thick steel disk configured for attachment of hoist rings used to lift basket 10 after it has been loaded. Both shield lid 54 and structural lid 56 are preferably welded to cylindrical shell 12 and have access means, preferably penetrations 62, best seen in FIG. 6, for draining basket 10, vacuum drying basket 10, and backfilling basket 10 with helium after shield lid 54 and structural lid 56 are installed. Penetrations 62 may be apertures or bores and are preferably sealed using multiple welds once the helium backfill process has been completed. Shield lid 54 is preferably supported during its installation by a shield support ring 64.

In operation and use basket 10 is extremely versatile, reliable, and may accommodate a large number of pressurized water reactor fuel assemblies, preferably twenty-four, while meeting the stringent requirements established by regulatory authorities both in the United States and abroad to ensure safety during the storage or transportation of fuel assemblies. Basket 10, when contained within a cask, is designed to withstand a wide variety of environmental hazards including earthquakes, floods, tornadoes, and various other accidents such as vertical drops on unyielding surfaces and the like. The basket shell, lid, and supporting structures are such that forces imposed on the contained fuel assemblies 48 during such hazardous conditions or accidents are maintained below those that would cause failure of the basket. Cylindrical shell 12 with welded end plates 52 and lids 54 and 56 provide ample support to sleeves 24, 30, 32, and 34 during and shock, accident or other stresses, thereby preventing distortion and maintaining stresses in the sleeves within acceptable limits. Basket 10 may be subjected to temperatures which vary across the basket internals or temperature gradients. The unique configuration of basket 10 and its internal supports provide the basket components with the capability to withstand the effects of various forces imposed on the basket, such as those from a drop event, without constraining the basket such that temperature gradients cause additional stresses in the basket components.

Basket 10 is configured to adequately dissipate heat generated by contained fuel assemblies 66. Basket 10 maintains temperature in the fuel assembly region below the level at which long term degradation of the assemblies could occur. Basket 10 provides a means to maintain fission reactions within the basket at a level which is significantly below the critical level necessary to sustain a fission chain reaction. This is achieved through the use of the sheet of neutron poison material 48 operably positioned between adjacent sleeves in basket 10. Basket 10 is specifically designed and constructed to minimize radiation exposure to plant workers and to the general public when the basket is loaded with fuel assemblies and is contained within a transportation, shipping, or storage cask.

As is evident from the above description, basket 10 may be provided composed of a variety materials used to construct various parts of the basket without jeopardizing or limiting the ability of the basket to meet the applicable regulatory criteria. For example, cylindrical shell 12 may be constructed of carbon steel, stainless steel, or other metallic alloys. Sleeves 24 may be composed, for example, of carbon steel, stainless steel, or other metallic alloys.

Additional advantages and modification will readily occur to those skilled in the art. The invention in its broader aspects is, therefore, not limited to the specific details, representative apparatus and illustrative examples shown and described. Accordingly, departures from such details may be made without departing from the spirit or scope of the applicant's general inventive concept.

What is claimed is:

1. A basket for transporting, storing, and containing nuclear fuel assemblies, comprising:

an internal assembly of sleeves comprising a plurality of independent sleeves arranged in a uniform pattern and secured within a cylindrical shell; each of said plurality of independent sleeves being sized to secure and contain a fuel assembly; said internal assembly of sleeves comprising a set of single sleeves centrally positioned in said basket, a set of corner sleeves including a single sleeve in each corner of said basket, and a set of double sleeves;

an internal support structure including a cross-shaped central support element and four angle shaped corner supports;

a sheet of neutron poison material being positioned to an inner wall of each of said plurality of sleeves for maintaining fission reactions within said basket below a critical level necessary to sustain a fission reaction;

a plurality of retaining clips for holding and securing a neutron poison material within the basket;

a support element for positioning and securing said plurality of independent sleeves;

a bottom plate secured to said cylindrical shell providing vertical support means for the plurality of independent sleeves;

a shield lid secured to the cylindrical shell including access means for selective entry into the basket; and, a lid element secured to said shield lid and to the cylindrical shell; said lid element including access means for selective entry into the basket.

2. The basket of claim 1, wherein each of said plurality of independent sleeves has a square cross-sectional configuration.

3. The basket of claim 1, wherein said fuel assembly is a pressurized water reactor fuel assembly.

4. The basket of claim 1, wherein said set of single sleeves centrally positioned in said basket comprises a set of four sleeves.

5. The basket of claim 1, wherein said set of corner sleeves comprises a set of four sleeves independently spaced from one another.

6. The basket of claim 1, wherein said set of double sleeves comprises a set of eight sleeves independently spaced and paired in sets of two sleeves.

7. The basket of claim 1, wherein said support element comprises two separate assemblies of steel plates.

8. A basket for a cask for transporting, storing, and containing pressurized water nuclear fuel assemblies, comprising:

an internal assembly of sleeves comprising a plurality of sleeves arranged in a uniform pattern and secured within a cylindrical shell; each of said plurality of independent sleeves being sized to secure and contain a fuel assembly; said internal assembly of sleeves comprising a set of single sleeves centrally positioned in said basket, a set of corner sleeves including a single sleeve in each corner or said basket, and a set of double sleeves;

an internal support structure including a cross-shaped central support element and four angle shaped corner supports;

neutron absorbing means for absorbing neutrons being secured to an inner wall of each of said plurality of sleeves for maintaining fission reactions within said basket below a critical level necessary to sustain a fission reaction;

support element means for positioning and securing said plurality of independent sleeves;

a bottom plate secured to said cylindrical shell providing vertical support means for the plurality of independent sleeves;

shield means for providing a shield element for said cylindrical shell secured to the cylindrical shell including access means for selective entry into the basket; and, lid means for providing a lid element being secured to said shield means and to the cylindrical shell; said lid element including access means for selective entry into the basket.

9. The basket of claim 8, wherein each of said plurality of independent sleeves has a square cross-sectional configuration.

10. The basket of claim 8, wherein said set of single sleeves centrally positioned in said basket comprises a set of four sleeves.

11. The basket of claim 8, wherein said set of corner sleeves comprises a set of four sleeves independently spaced from one another.

12. The basket of claim 8, wherein said set of double sleeves comprises a set of eight sleeves independently spaced and paired in sets of two sleeves.

13. The basket of claim 8, wherein support element comprises two separate assemblies of steel plates.

* * * * *